United States Patent [19]

Main

[11] Patent Number: 4,808,907

[45] Date of Patent: Feb. 28, 1989

[54] CURRENT REGULATOR AND METHOD

[75] Inventor: William E. Main, Mesa, Ariz.

[73] Assignee: Motorola, Inc., Schaumburg, Ill.

[21] Appl. No.: 194,752

[22] Filed: May 17, 1988

[51] Int. Cl.[4] ..... G05F 3/20

[52] U.S. Cl. ..... 323/316; 323/312

[58] Field of Search ..... 323/312, 313, 314, 315, 323/316; 330/257, 288, 297; 307/296 R, 297

[56] References Cited

U.S. PATENT DOCUMENTS

| | | | |
|---|---|---|---|
| 4,251,743 | 2/1981 | Hareyama | 323/316 |
| 4,361,797 | 11/1982 | Kojma et al. | 323/316 |
| 4,703,249 | 10/1987 | DeLaplaza et al. | 323/316 |
| 4,716,358 | 12/1987 | Fucito | 323/316 |
| 4,740,766 | 4/1988 | Metz | 323/316 |

*Primary Examiner*—Peter S. Wong

*Attorney, Agent, or Firm*—Michael D. Bingham

[57] ABSTRACT

An integrated circuit for providing a regulated output current comprises an output transistor for producing the output current, a feedback circuit including a current mirror for sensing the magnitude of the output current and providing a feedback current proportional thereto and a driver circuit for comparing the feedback current to an externally generated current and biasing the output transistor accordingly to regulate the magnitude of the output current to a predetermined value. Preferably, the external current is generated through an external resistor coupled to an input of the driver curcuit and the current mirror wherein the magnitude of the external current is directly proportional to a reference voltage provided on chip and applied to an additional input of the driver circuit the latter of which functions as an operational amplifier.

11 Claims, 1 Drawing Sheet

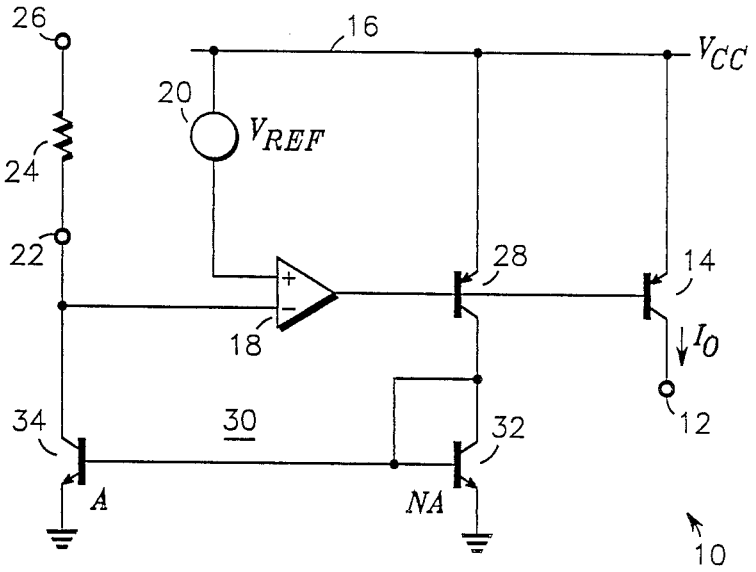
FIG. 1
FIG. 2
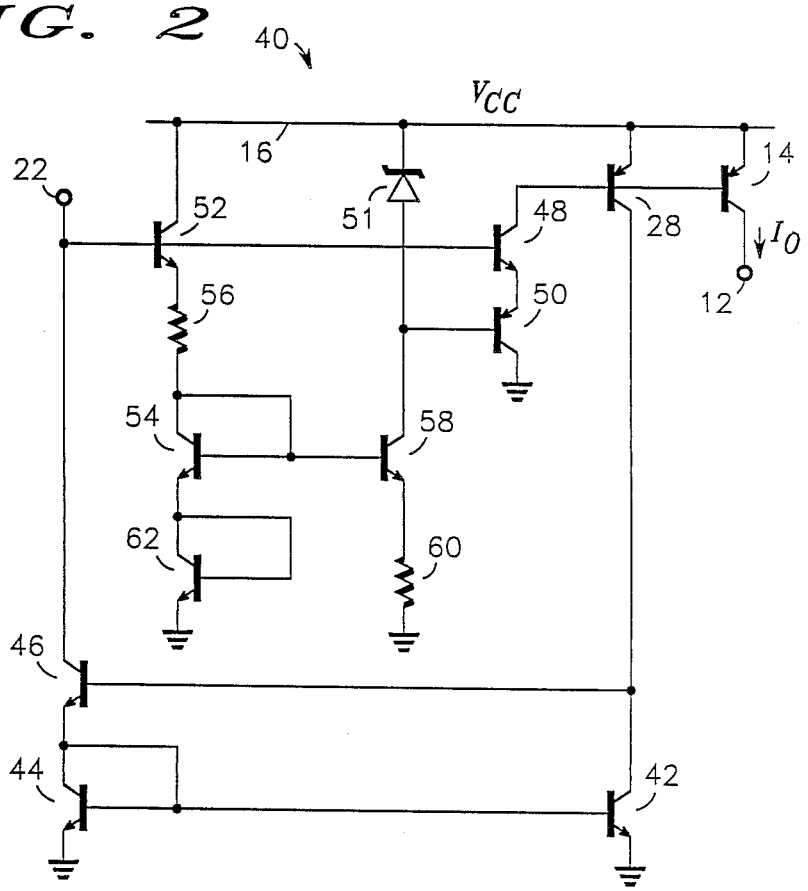

CURRENT REGULATOR AND METHOD

BACKGROUND OF THE INVENTION

The present invention relates to current sources and, more particularly, to a circuit and method for providing an output current having a regulated and known magnitude.

Current sources comprising current mirrors for providing output currents that are a function of a reference current are well known in the art. An example of a prior art circuit for providing an output current that is proportional to a reference current is described in U.S. Pat. No. 4,642,551. This current source comprises a current mirror formed by two transistors having their bases coupled together and their collectors respectively coupled to the inverting and non-inverting input of an operational amplifier. A reference current is applied to the collector of the transistor having its collector connected to the non-inverting input of the operational such that an output current is produced through the collector-emitter conduction path of the other transistor of the current mirror which is proportional to the reference current. The operational amplifier provides feedback current to the current mirror which varies as a function of the output current whereby the output current tends to be held constant, i.e., is regulated.

Typically, the output current from the above described current source is turned around using a conventional PNP current mirror coupled to the collector of the output thereof in order to source current to a load. Although this type of regulated current source functions quite well in bipolar circuits fabricated using standard bipolar integrated processes, its performance will suffer if fabricated in integrated circuit form using contemporary low voltage bipolar integrated circuit processes. This problem arises due to the low forward current gain, beta, of PNP transistors associated with the low voltage processes currently used in the industry. Because of the low beta of PNP transistors the prior art suffers loading affects which is highly undesirable.

Hence, a need exists for providing a regulated current source that is suited to be manufactured in integrated circuit form using conventional low power, low voltage bipolar integrated circuit processes.

SUMMARY OF THE INVENTION

Accordingly, it is an object of the present invention to provide an improved current regulator.

It is another object of the present invention to provide an improved integrated current regulator circuit.

Yet another object of the present invention is to provide a method for producing a regulated current.

In accordance with the above and other objects there is provided a current regulator comprising an output stage for providing an output current, a feedback circuit for sensing the magnitude of the output current and providing a feedback current that is proportional to the output current and circuit means for comparing the magnitude of the feedback current to a reference current and for varying the magnitude of the output current accordingly to force the feedback current to be equal to the reference current.

BRIEF DESCRIPTION OF THE DRAWINGS

FIG. 1 is a simplified schematic diagram illustrating the current regulator of the preferred embodiment; and FIG. 2 is a detailed schematic diagram of the current regulator of FIG. 1.

DETAILED DESCRIPTION OF THE PREFERRED EMBODIMENT

Turning to FIG. 1 there is shown current regulator 10 of the present invention which provides a regulated output current, Io, at output terminal 12. It is understood that current regulator 10 is suited to be manufactured in integrated circuit form. Current regulator 10 includes an output stage which, as illustrated comprises transistor 14 having its collector-emitter conduction path coupled between power supply conductor 16 and output terminal 12 and its base coupled to the output of operational amplifier or driver circuit 18. The non-inverting input of operational amplifier 18 is supplied a reference voltage $V_{REF}$ from voltage supply 20, the latter being coupled to power supply conductor 16 to which is supplied Vcc. The inverting input of amplifier 18 is connected to terminal 22. In the preferred embodiment an external resistor 24 is connected to the inverting input of amplifier 18 between terminals 22 and 26. A feedback circuit comprising transistor 28 and current mirror 30 is provided for sensing the magnitude of Io and providing a feedback signal at the inverting input of amplifier 18 to regulate Io to a value that is equal to $V_{REF}/R$, where R is the resistance of resistor 24, as will be explained. Transistor 28 has its base-emitter junction coupled in parallel with the base-emitter junction of transistor 14 and its collector coupled to current mirror 30. Current mirror 30 comprises diode connected transistor 32 and transistor 34 connected in a well known configuration. As shown the emitter area of transistor 32 is area ratioed with respect to the emitter area of transistor 34 and is N times larger, where N may be any positive integer.

In operation, with terminal 26 coupled to Vcc, op amp 18 will supply base current drive to transistor 14 such that the device turns on to supply the output current Io. Current is supplied through resistor 24 the magnitude of which is equal to $V_{REF}/R$. The current flow through transistor 14 is sensed by transistor 28, which due to its base-emitter being in parallel with that of the output transistor will source a current at the collector thereof that is equal to Io. This current is sourced to diode connected transistor 32 and is mirrored by transistor 34 which provides a feedback signal at terminal 22. Thus, a current is forced to flow through transistor 34 that is essentially equal to Io and is compared to the reference current source at terminal 22 such that Io is regulated to a magnitude that is equal to $V_{REF}/R$. It is recognized that if terminal 26 is returned to ground or zero volts that transistor 14 will be rendered non-conductive and Io will go to zero. Hence, current regulator can be switched on and off by switching terminal 26 between Vcc and ground using only one external pin (terminal 22) if the regulator is manufactured in integrated circuit form.

Although current regulator 10 has been described as using a single transistor output stage, it is understood that multiple regulated output currents can be provided by paralleling additional transistors to output transistor 14 or by making transistor 14 a multiple collector device. Moreover, the functions of transistors 14 and 28 could be merged into a single transistor having multiple collectors. Furthermore, by area ratioing the collectors of transistors 14 and 28 and/or area ratioing the emitters of transistors 32 and 34, the magnitude of Io can be regulated to a value proportional to $V_{REF}/R$ as is well understood.

Referring to FIG. 2, there is shown current regulator 40 of the preferred embodiment as fabricated in integrated circuit form. Where possible, components of regulator 40 corresponding to like components of FIG. 1 are designated by the same reference numbers. The current mirror comprising the above described feedback circuitry includes transistors 42, 44 and 46 with transistor 44 being connected as a diode having its collector-base coupled both to base of transistor 42 and the emitter of transistor 46. The collector of transistor 42 and the base of transistor 46 are coupled to the collector of transistor 28 while the collector of transistor 46 is coupled to terminal 22 whereby a feedback signal drives the input of amplifier circuitry or circuit means for driving the base of transistor 14 to regulate the current Io. This amplifier is shown as comprising transistor 48 having its emitter coupled to transistor 50 and its collector output coupled to the bases of transistors 28 and 14 and its base coupled to terminal 22. The base of transistor 50 is connected to the anode of Zener diode 51 while the cathode is returned to power supply conductor 16. Biasing and start up circuitry comprising transistor 52 having its base coupled to terminal 22 and its collector-emitter conduction path connected in series with a pair of diode connected transistors 54 and 62 via resistor 56 and including transistor 58 is also provided for turning on the Zener diode. Transistor 58 has its base coupled to the base-collector of diode transistor 54 and its collector-emitter conduction path coupled in series between the anode of Zener diode 51 and ground or VEE supply via resistor 60.

In operation, terminal 22 is held at a voltage potential equal to Zener diode voltage minus the two base-emitter voltage drops of transistors 48 and 50. Transistor 48 is turned on to bias transistors 28 and 14 into conduction with transistors 28 and 14 being matched, Io will be mirrored through transistor 28 to drive the current mirror. Io is regulated to a value that is equal to the fixed voltage set at terminal 22 divided by the resistance of resistor 24 (FIG. 1) that is coupled thereto. Transistor 28 senses the current Io to provide a feedback signal via the current mirror to terminal 22 to vary the base drive supplied thereto and to transistor 14 accordingly. For example, if Io should become greater than the current source to terminal 22 transistor 28 will source a greater current to the input of the current mirror Hence, transistor 46 conducts harder thereby lower the potential at the base of transistor 48. Transistor 48 will therefore conduct less whereby less base drive is available to output transistor 14. Transistor 14 will then be rendered less conductive until such time as Io equals the reference current supplied to terminal 22. The reverse is true wherein the feedback from sensing transistor 28 and the current mirror will cause transistor 14 to increase conduction if Io is less than the current supplied to terminal 22.

Hence, what has been described above is a novel current regulator circuit that is suited to be manufactured in integrated circuit form using conventional low power, low voltage bipolar fabrication processes.

What is claimed is:

1. A current regulator, comprising:

a voltage source for providing a reference voltage;

an output stage for providing an output current;

circuit means for providing bias drive to said output stage to control the magnitude of said output current, said circuit means having a first input coupled to said voltage source and a second input at which is produced a voltage that is directly proportional to said reference voltage;

a current source for supplying a reference current to said second input of said circuit means the magnitude of which is a function of said voltage appearing at said second input of said circuit means; and feedback circuit means responsive to said output stage for providing a feedback signal to said second input of said circuit means that is a function of said magnitude of said output current such that the bias drive to said output stage is varied to regulate said output current to a value that is proportional to said reference current, said feedback circuit means including a current mirror.

2. The current regulator of claim 1 wherein said output stage comprises a first transistor having a base, emitter and collector, said base being coupled to an output of said circuit means, said emitter being coupled to a power supply conductor, said collector being coupled to an output of the regulator.

3. The current regulator of claim 2 wherein said feedback circuit means includes:

a second transistor having a base, emitter and collector, said base being coupled to said output of said circuit means and said emitter being coupled to said power supply conductor and said collector coupled to an input of said current mirror; and said current mirror having an output coupled to said second input of said circuit means.

4. The current regulator of claim of claim 3 wherein said circuit means is an operational amplifier.

5. The current regulator of claim 3 wherein said circuit means includes:

a third transistor having a base, emitter and collector, said base being coupled to said voltage source, said collector being coupled to an additional power supply conductor;

a fourth transistor having a base, emitter and collector, said base being coupled to said second input of said circuit means, said collector being coupled to said output of said circuit means and said emitter being coupled to said emitter of said third transistor; and bias circuitry coupled to said voltage source.

6. An integrated circuit for providing a regulated output current, comprising:

an output stage for providing at least a first output current at an output of the circuit;

a driver circuit for providing a bias drive signal to said output stage, said driver circuit having first and second inputs and an output, said output being coupled to an input of said output stage;

a voltage source coupled to said first input of said driver circuit for providing a reference voltage; and a feedback circuit for sensing the magnitude of said output current and providing a feedback signal at said second input of said driver circuit means.

7. The integrated circuit of claim 6 wherein said output stage includes a first transistor having a base, an emitter and at least one collector, said collector being coupled to said output of the circuit, said base being coupled to said output of said driver circuit and said emitter being coupled to a first power supply conductor.

8. The circuit of claim 7 wherein said voltage source includes a Zener diode coupled between said first power supply conductor and said first input of said driver circuit.

9. The circuit of claim 8 wherein said driver circuit means includes:

a second transistor having a base, an emitter and a collector, said collector being coupled to said output of said driver circuit and said base being coupled to said second input of said driver circuit;

a third transistor having a base, an emitter and a collector, said emitter being coupled to said emitter of said second transistor, said base being coupled to said first input of said driver circuit and said collector being coupled to a second power supply conductor; and bias circuit means coupled to said first input of said driver circuit for establishing bias to said Zener diode and said third transistor.

10. The circuit of claim 9 wherein:

said feedback circuit includes:

(a) transistor means for sensing the magnitude of said output current flowing through said first transistor and providing a current the magnitude of which is proportional to said output current; and (b) a current mirror coupled between said transistor means and said second input of said driver circuit for sinking a current proportional to said output current; and said second input of said driver circuit being coupled to an external terminal of the integrated circuit.

11. A method for producing a regulated current comprising the steps of:

generating a first current;

generating a second current the magnitude of which is directly proportional to a reference voltage;

sensing the magnitude of said first current and providing a feedback current that is proportional to said magnitude of said first current; and comparing said feedback current to said second current; and varying the magnitude of said first current accordingly until said feedback current equals said second current.

* * * * *